United States Patent [19]

Schwarzbäcker

[11] Patent Number: 4,884,553

[45] Date of Patent: Dec. 5, 1989

[54] DEVICE FOR HEAT-TREATING FOOD ITEMS

[75] Inventor: Werner Schwarzbäcker, Untereglfing, Fed. Rep. of Germany

[73] Assignee: Convotherm Elektrogerate GmbH, Untereglfing, Fed. Rep. of Germany

[21] Appl. No.: 123,686

[22] Filed: Nov. 23, 1987

[30] Foreign Application Priority Data

Nov. 24, 1986 [DE] Fed. Rep. of Germany ..... 8631399
Jul. 6, 1987 [DE] Fed. Rep. of Germany ..... 3722282

[51] Int. Cl.[4] ..... A21B 1/08

[52] U.S. Cl. ..... 126/20; 126/21 A; 134/177; 219/401

[58] Field of Search ..... 126/20, 20.1, 20.2, 126/21 A; 134/172, 177, 175; 219/401; 426/510; 62/303; 122/379, 390, 398

[56] References Cited

U.S. PATENT DOCUMENTS

| | | | |
|---|---|---|---|
| 1,863,432 | 6/1932 | Bobbin et al. | 126/20 |
| 3,593,728 | 7/1971 | Saver | 134/175 X |
| 3,810,787 | 5/1974 | Yoeli et al. | 134/172 X |
| 4,506,598 | 3/1985 | Meister | 126/20 X |

FOREIGN PATENT DOCUMENTS

| | | |
|---|---|---|
| 0140841 | 8/1985 | European Pat. Off. . |
| 0197733 | 10/1986 | European Pat. Off. . |
| 6911912 | of 0000 | Fed. Rep. of Germany . |
| 288495 | 6/1959 | Fed. Rep. of Germany . |
| 1890603 | 4/1964 | Fed. Rep. of Germany . |
| 2842771 | 10/1980 | Fed. Rep. of Germany . |
| 0478963 | 11/1969 | Switzerland . |

OTHER PUBLICATIONS

Topf-und Behaelter-Spuelmaschine KS5115.
Topf-und Behaelter-Spuelmaschine KS5120.

*Primary Examiner*—Margaret A. Focarino
*Attorney, Agent, or Firm*—Darby & Darby

[57] ABSTRACT

A device for heat-treating food items with vapor or a vapor-hot air mixture comprises a cooking chamber, in which food items are treated with vapor from a vapor generator. For cleaning the cooking chamber a squirting or spraying device insertable into the cooking chamber (5) is provided, which is built in the manner of a hand-held shower head and connected to a water connection. This spraying device can be connected to a water pipe present on the equipment, which is required for supplying water users like vapor generator, condensator or cooling device. The spraying device, however, can also be arranged on a water connection—arranged fixedly on the building—located in the vicinity of the device for heat treatment.

9 Claims, 4 Drawing Sheets

DEVICE FOR HEAT-TREATING FOOD ITEMS

FIELD OF THE INVENTION

The invention relates to a device for heat-treating food items with vapor or a vapor-hot air mixture in a cooking chamber closable with a door.

BACKGROUND OF THE INVENTION

Devices of this nature must very frequently be cleaned, because during preparation of foods with circulating vapor or a circulating vapor-hot air mixture, precipitates are deposited on the wall by the heat carriers, which deposits have escaped the food items. This is especially the case when preparing good-sized roasts, since the juice, even if only to a slight extent, is distributed on the walls. These precipitates would, if they were not removed, lead to deposits, which would become encrusted on the walls due to the effect of heat. In order to clean the cooking chamber, it is sprayed with a cleaning solution, following which subsequently for a given time vapor is introduced into the cooking chamber, so that the deposits are loosened. Subsequently, the cooking chamber must be washed. Since this process is time consuming and cumbersome, because facilities of this nature frequently have a large cooking chamber, which, especially in the back regions, can be reached by hand only with difficulty. Moreover, temperatures in the cooking chamber following the vapor process are relatively high.

SUMMARY OF THE INVENTION

It is a task of the invention to facilitate cleaning the cooking chamber and all parts, which due to the heat carrier, is coated with precipitates. This task is solved according to the invention by a device for heat-treating food items with vapor or a vapor/hot air mixture in a cooking chamber closable with a door which includes a squirting or spraying device for spraying and cleaning the chamber.

Through this design, cumbersome and time-consuming washing down of the cooking chamber sprayed with cleaning agents is not only facilated but the time expenditures are shortened. In this connection, cooking chamber refers to all areas of the device, in which through the heat carrier vapor or vapor-hot air mixture precipitates can be deposited.

In the preferred design of the invention, the squirting or spraying device comprises a spraying head in the manner of a hand-held shower and a flexible supply line, which connects the spraying head with a water connection.

In order to keep the constructional expenditures to a minimum, the water connection for the spraying device can, according to the invention, be provided outside the cooking chamber. In the simplest case, this arrangement is made so that the water pipe, which is necessary anyhow for the water user provided in the device, is provided with a branch-off connection piece, at which the flexible supply line, that is a flexible hose, is connected. Water consumers, in addition to the vapor generator, are also condensation devices for the regenerated exhaust vapors and cooling installation, which can be provided, in order to cool the device down following a cooking process at high temperature, so that a treatment process requiring lower temperatures can follow. In a simple embodiment, this hose can be connected fixedly with the water connection, it is, however, also possible to provide a detachable plug-in connection known per se, as it becomes necessary, if in further models of devices in accordance with the invention, the water connection for the spraying device is provided on the device within the cooking chamber and the spraying device is detachably connectable with the water connection. This design is, in fact, more elaborate, but offers, the advantage that the danger of spraying down the entire device from the outside, is substantially lessened, because the hose is only long enough so that it is sufficient to spray down the cooking chamber. Because of the treatment of the food items with vapor, it is absolutely necessary that all electrical devices, like the heating device, are built vapor-proof and, hence, waterproof. The device has ventilation slits on the exterior, through which, upon spraying down the device, water from the outside can reach, for example, electrical or electronic control devices, which, since they are not connected with the interior space, are also not encapsulated to be vapor and water-proof. For use as a water connection, a connection attached fixedly to the building provided in the immediate vicinity of the cooking device can also be used.

In order to simplify the cleaning process, particularly in spraying the cooking chamber with the cleaning solution, in a further aspect of the invention, the spraying device is provided with an adding device for adding a cleaning agent to the spraying water. This permits applying the cleaning agent in the same simple, pleasant, and rapid way as by subsequently spraying of the cooking chamber.

The adding device can comprise a receptacle for a cleaning agent within the spraying head, which can be carried along by the water stream. Here, one can draw on known models, for example, from car washing brushes with a shampooing device or from garden sprayer installations with an adding device for insecticides or fertilizers.

The adding device can also be built in the manner of a water jet blast, in which the water jet due to its streaming energy pulls along cleaning agents from a connected container.

In a simple model of the invention, the spraying head can have a manually actuatable shut-off valve, which can be actuated with a button or lever. Such shut-off valves are known in known hand sprayers on sinks in kitchen fixtures.

In order to increase safety for the operators so, that even in the case of defective insulations no danger exists, further designs of the invention are provided with a shut-off valve in the supply lines of the spraying device, which in its open position interrupts the current supply for the electrically operated parts of the device.

In one embodiment, which from an expenditure point of view is simple, a hook device is provided, in order to hang the spraying device. In a more elaborate model, a roll-up device for the flexible supply line can be provided, which is best arranged behind panelling. In table models, such roll-up device can be mounted below the table top. Use of a roll-up device is, however, not limited to mounting the spraying device outside the cooking chamber. In larger units, in which correpondingly a great deal of space is available, such roll-up device can also be provided behind panelling in a wall recess of the cooking chamber, so that the detachable connection of the supply line with the water connection usually necessary in the interior arrangement can be dispensed with.

This detachable connection is, after all, only necessary, if the supply line and the spraying head cannot remain in the interior of the cooking chamber.

BRIEF DESCRIPTION OF THE DRAWINGS

Below, the invention is explained in greater detail with reference to embodiments, which are represented in the drawings, in which.

DESCRIPTION OF THE PREFERRED EMBODIMENTS

Figure 1:
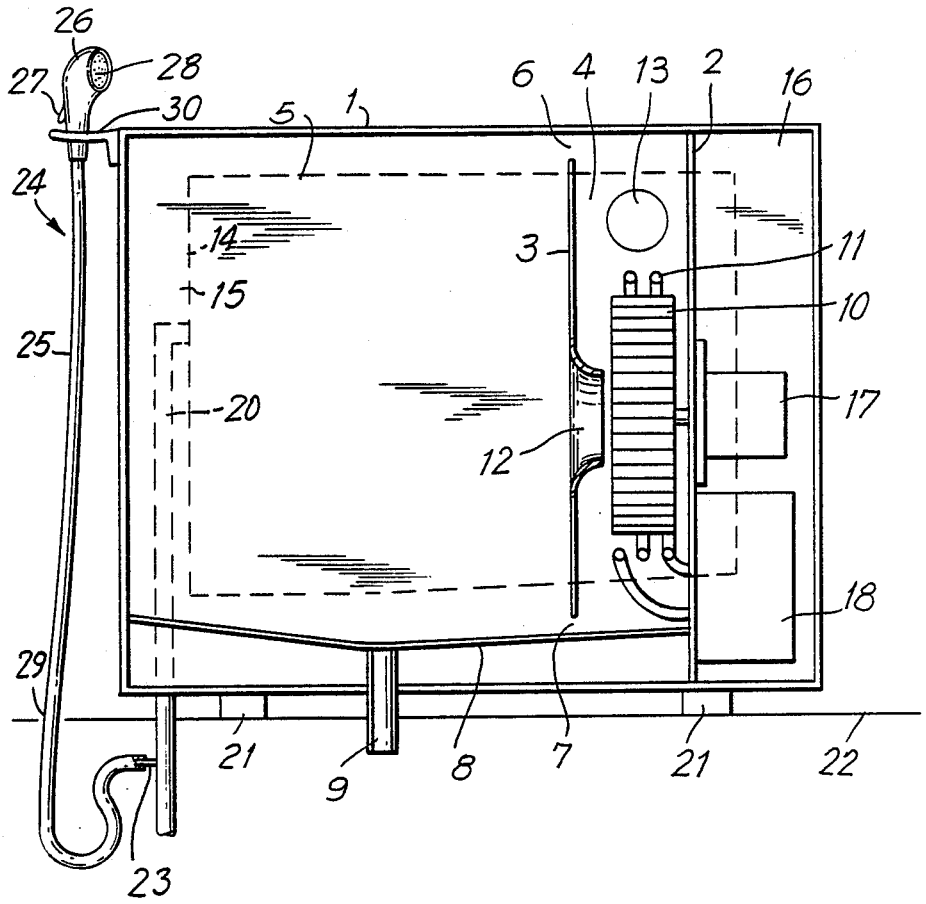
FIG. 1 is a front view of an apparatus with a spraying device with front panelling and door removed.

The device for heat-treating food items is an apparatus, which comprises a housing 1, which, in addition to the customary and not shown front panelling and door, has a partition wall 2, which subdivides the housing into two closely separated chambers. In one chamber of the housing, through an additional partition wall 3, a pressure chamber 4 is separated from a cooking chamber 5, with the pressure chamber 4 being connected by way of slits 6 and 7 with the cooking chamber. The floor of the cooking chamber is denoted by 8 and ends in an outlet 9, from which fat, cleaning solution etc. from the cooking chamber reach a waste water pipe, which is fixedly installed in the building. In the pressure chamber 4, a blower 10 is provided, supplied by the heater 11 for heating up the ambient air, which is sucked in through an aperture 12 in the partition wall 3 from the cooking chamber 5 and by way of slits 6 and 7 is moved into the cooking chamber after being heated. Into this pressure chamber leads a vapor inlet connecting piece 13 of a vapor generator 14, which is outside the rear wall 15 of the equipment. In the chamber of the equipment which is to the right of the partition wall 2, denoted by 16, a motor 17 for the blower 10 and all control elements are stored, which are together labeled 18 and serve to control the heater 11, a heating means 19 of the vapor generator 14 as well as other elements required for operating the equipment. The motor 17 and the control elements 18 are, hence, located on the one side of the equipment while the vapor generator 14 is arranged at the rear side of the equipment. This vapor generator is supplied with fresh water through a supply pipe 20, which leads from below into the equipment. The represented equipment is a table model, which rests on feet 21 on a table top 22.

Immediately below the table top, the supply pipe 20 is provided with a branch-off connecting piece, which serves as water connection 23 for a squirting respectively or spraying device labeled overall as 24. This spraying device 24 comprises a flexible hose 25, which is connected to the water connection 23 and a spraying head 26, built in the manner of a hand-held shower head. The spraying head 25 is provided with an actuating lever 27, which actuates a valve located in the spraying head 25, which allows water to leave from the spraying head through the spray nozzles 28. The flexible hose 25, which is led through an aperture 29 in the table top 22, is suspended below the table top forming a relatively large loop when the spraying head is hung onto a hanging device 30 provided at the upper edge of the equipment. The flexible hose here is so long that it permits introducing the spraying head 26 into the cooking chamber to spray it.

Figure 2:
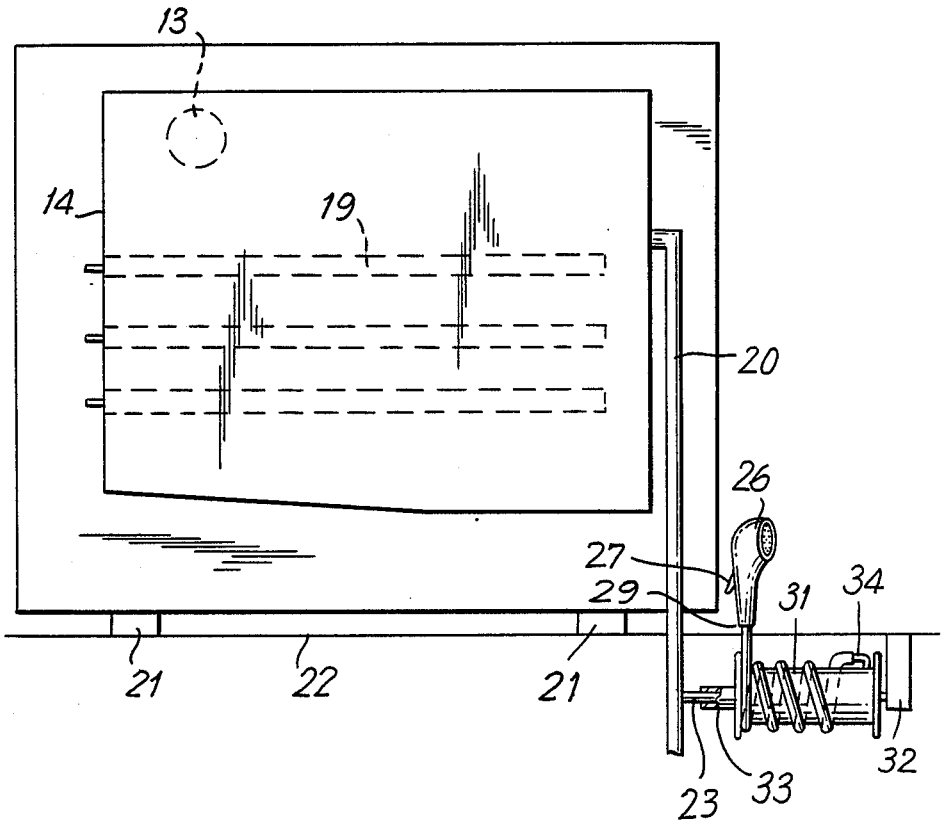
FIG. 2 illustrates a rear view of the device with the rear panelling removed and the spraying device modified.
Figure 3:
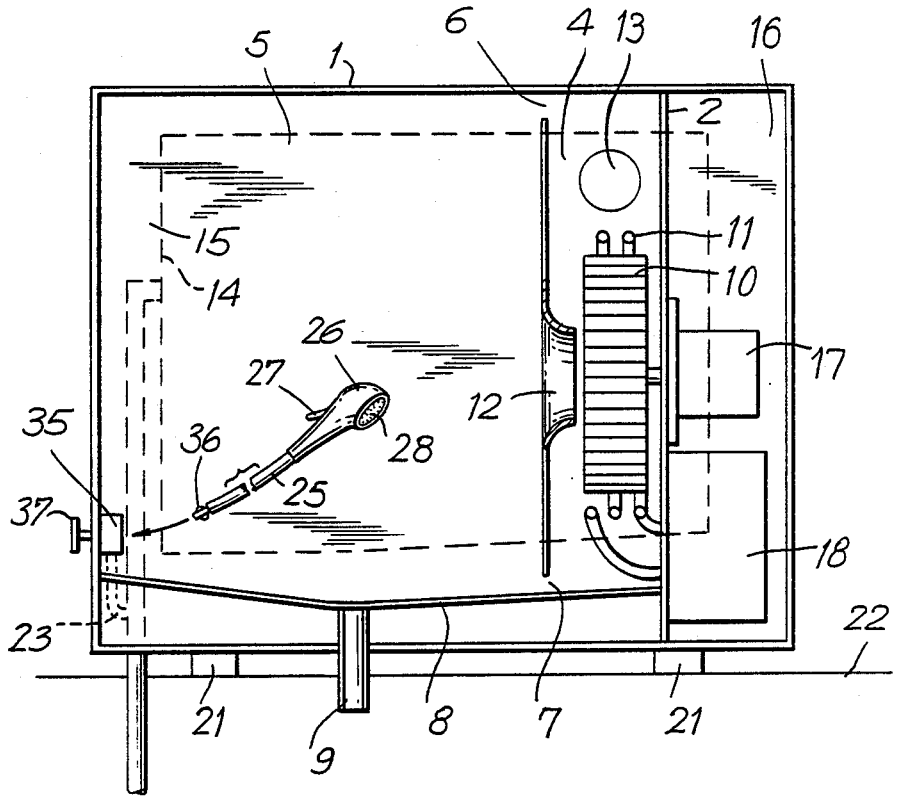
FIG. 3 illustrates a representation of the apparatus corresponding to FIG. 1 with a further variant of the spraying device.
Figure 4:
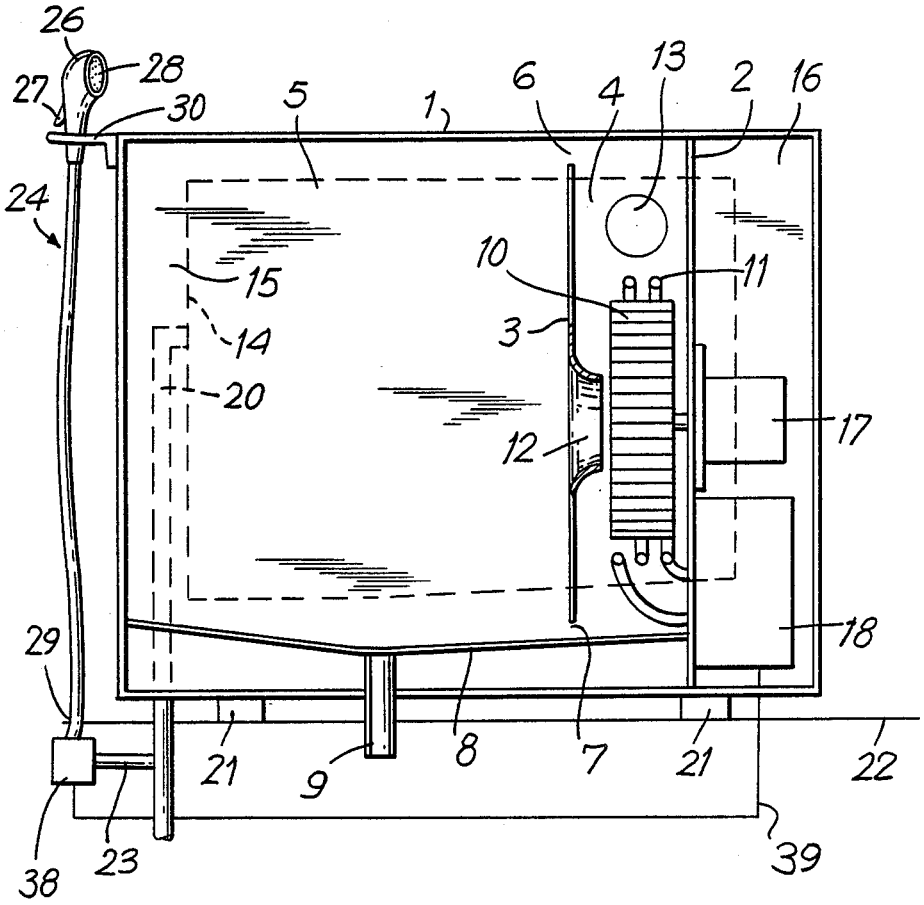
FIG. 4 shows a representation of the apparatus corresponding to FIG. 1 with the spraying device designed differently.

In FIGS. 2 to 4, all parts, which correspond to those in FIG. 1, are given the same reference numbers.

In FIG. 2, a variant of the spraying device is represented. The deviation compared to FIG. 1 consists in that the flexible hose 25 is rolled up on a roll 31 spring-loaded in the rotational direction, which is held by a mounting 32 on the underside of the table top 22. The roll 31 is connected to the water connection 23 by a coupling piece 33, which permits rotational movement of the roll 31. The end of the flexible hose 25 facing away from the spraying head 26 is connected at an angle with connecting piece 34 which connects to the interior of the roll 31, so that by way of this roll 31, a connection to the water connection 23 exists. In this model the spraying head 26 is plugged into a recess 29 of the table top 22 while the flexible hose is rolled up on the roll 31.

In the model according to FIG. 3, the water connection 23 is connected to a plug receptacle 35 located in the interior of the cooking chamber, into which the flexible hose 25, if needed, can be plugged with a plug arranged at its end facing away from the spraying head 26. Inside the plug receptacle is a valve, which is actuable by a handle for opening the water connection when the flexible hose 25 is plugged into the plug receptacle 35.

In FIG. 4 a further modification of the spraying device is shown. This modification comprises a magnetic valve 38, which is connected to the water connection 23. The magnetic valve 38 is connected to the control 18 by line 39 and switches off the current supply to the equipment upon being opened by a line connected to the hand lever 27 and embedded in the flexible hose.

While the foregoing description and drawings represent the preferred embodiments of the present invention, it will be obvious to those skilled in the art that various changes and modifications may be made therein without departing from the true spirit and scope of the present invention.

I claim:

1. In a device for heat-treating food items having means for providing vapor or a vapor/hot air mixture in a cooking chamber closable with a door, the improvement comprising a squirting or spraying device insertable into the cooking chamber for rinsing and cleaning it; said spraying device including a spraying head in the form of a hand-held shower and a flexible supply line, which connects the spraying head with a water connection, said water connection being provided on the device outside the cooking chamber, said water connection also providing a source for said vapor.

2. A device as in claim 1 wherein the spraying device is fixedly connected to the water connection.

3. In a device for heat-treating food items having means for providing vapor or a vapor/hot air mixture in a cooking chamber closable with a door, the improvement comprising a squirting or spraying device insertable into the cooking chamber for rinsing and cleaning it; said spraying device including a spraying head in the form of a hand-held shower and a flexible supply line, which connects the spraying head with a water connection, and wherein the water connection for the spraying device is provided on the device within the cooking chamber and the spraying device is detachably connectable with the water connection.

4. A device as stated in claim 2 or claim 3, wherein the spraying device is provided with an adding device for adding a cleaning agent to the spraying water.

5. A device as in claim 4, wherein the adding device within the spraying head comprises a receptacle for a cleaning agent, which can be carrier along by the water stream.

6. A device as in claim 4, wherein the adding device includes means for providing a water jet blast.

7. A device as in claim 1 or claim 3, wherein the spraying head has a manually actuatable shut-off valve.

8. A device as in claim 1 or claim 3, wherein in the supply line of the spraying device, a shut-off valve is provided, which in its open position, interrupts the current to the electrically operated parts of the device.

9. A device as in claim 1 or claim 3, wherein a rolling up device for the flexible supply line is provided.

* * * * *